US006145659A

United States Patent [19]

Faircloth et al.

[11] Patent Number: 6,145,659

[45] Date of Patent: Nov. 14, 2000

[54] FOLD PACKAGE WITH INTEGRAL HANGING TAB

[75] Inventors: Michael Faircloth, Winston-Salem; Reid London, Clemmons, both of N.C.

[73] Assignee: Sara Lee Corporation, Winston-Salem, N.C.

[21] Appl. No.: 09/370,653

[22] Filed: Aug. 6, 1999

[51] Int. Cl.[7] ..... B65N 85/18; B65N 5/462

[52] U.S. Cl. ..... 206/292; 206/281; 206/806; 229/87.15; 229/117.18

[58] Field of Search ..... 206/278, 281, 206/292, 299, 806; 229/87.15, 117.18

[56] References Cited

U.S. PATENT DOCUMENTS

| | | | |
|---|---|---|---|
| 877,347 | 1/1908 | Lazer | 206/806 X |
| 955,880 | 9/1910 | Jager | 206/806 X |
| 1,596,521 | 8/1926 | Farnhorn | 206/806 X |
| 1,806,149 | 5/1931 | Daugherty | 206/806 X |
| 3,462,006 | 8/1969 | Scott | 206/297 X |
| 3,589,508 | 6/1971 | Burchett | 229/87.15 X |
| 3,695,508 | 10/1972 | Hoching | 206/806 X |
| 3,814,303 | 6/1974 | Smith | 206/806 X |
| 3,884,350 | 5/1975 | Johansson | 206/806 X |
| 4,020,847 | 5/1977 | Russell | 206/281 |
| 4,257,522 | 3/1981 | Thorneburg | 206/299 |
| 4,592,163 | 6/1986 | Wilson | 206/806 X |

FOREIGN PATENT DOCUMENTS

| | | | |
|---|---|---|---|
| 5-254539 | 10/1993 | Japan | 229/117.18 |

*Primary Examiner*—Bryon P. Gehman
*Attorney, Agent, or Firm*—Charles Y. Lackey; Kilpatrick Stockton LLP

[57] ABSTRACT

A fold package formed of a shell which has closing members connected to the shell. One of the closing members has a tab forming an engaging portion and an upper wider portion all cut in and removed from the closing member. The engaging portion is foldable upon itself and moves away from the closing member to form an extending hanging tab. An opening is provided in the tab engaging portion to facilitate hanging the package.

6 Claims, 2 Drawing Sheets

FOLD PACKAGE WITH INTEGRAL HANGING TAB

BACKGROUND OF THE INVENTION

1. Field of the Invention

The present invention relates to a folding package and, more particularly, to a substantially flat folding closable package having a self-contained integral extending hanging tab to facilitate hanging the package on a suitable support member.

2. Description of the Prior Art

Apparel packaging, particularly with hosiery products, has traditionally been in the form of boxes or flat hosiery package designed to display the garment which is ultimately enclosed in cellophane or a suitable plastic material. Such package is usually displayed within specially designed counters or in free-standing displays.

Other product display procedures involve hanging the garment on a rack or hanger with no enclosure so that the consumer can touch the garment and examine it closely. While this technique is acceptable in a number of circumstances, it is not desirable to leave open a hosiery package so that the consumer touches the actual fabric of the garment. More often, samples of the fabric of the garment are positioned on the display for close consumer examination.

There is a desire and need to display flat packaging in a more observable manner and to remove it from the clutter of the counter that often occurs when consumers constantly pick up and replace packaged garments for close inspection. Hanging flat hosiery packages on a display requires some form of hanging device to be utilized with the package that will engage a support member on the display and maintain the package in the desired location. Individual hanging devices are often used for this purpose, however, they represent an expensive way of handling the product since they need to be manually fixed to the package and the package thereafter affixed to the support member.

Thus, there is a perceived need for a hanging hosiery package that eliminates the need for an individual hanging attachment and includes a self-contained hanging element within the package itself. It is to this perceived need that the present invention is directed.

OBJECTIVES AND SUMMARY OF THE INVENTION

A primary objective of the present invention is to provide an apparel package having a self-contained hanging tab that will permit the package to be suspended from a support member.

Another objective of the present invention is to provide a package of the type described wherein the hanging tab on the package is self-contained within one of the foldable panels of the package.

Still another objective of the present invention is to provide a package of the type described having secondary fold portions to provide a package thickness dimension.

The foldable package of the present invention includes a shell having a front panel, first and side panels foldably connected to the front panel, a bottom panel foldably connected to the front panel, and a top panel foldably connected to the front panel. The top panel has a cutout tab with a lower front panel connecting portion and an upper portion all cut within the top panel and removable therefrom. The lower front connecting portion is folded upon itself when moved away from the top panel to form an extending hanging tab, and an opening extended through the folded upon itself lower front connecting portion facilitates hanging the package. The first and second side panels each have a secondary fold portion positioned between the front panel and the first and side panels to provide a package thickness dimension. The package is particularly useful in holding for display knitting hosiery products, such as ladies' fine denier fashion hosiery.

Thus, there has been outlined in summary form the more important features of the invention in order that the detailed description that follows may be better understood and in order that the present contribution to the art may be better appreciated. There are obviously additional features of the invention that will be described hereinafter which will form the subject matter of the claims appended hereto. It is to be understood that the invention is not limited in its application to the details of construction and to the arrangement of the components set forth in the following description or illustrated in the drawings. The invention is capable of other embodiments and of being practiced and carried out in various ways.

It is also to be understood that the phraseology and terminology herein are for the purpose of description and should not be regarded as limiting in any respect. Those skilled in the art will appreciate the concept upon which this disclosure is based and that it may readily be utilized as a basis for designing of the structures, methods, and systems for carrying out the several purposes of the present invention It is also to be understood that the abstract is neither intended to define the invention of the application, which is measured by its claims, nor to limit its scope in any way.

This summary and these objectives of the invention, along with the various features of novelty which characterize the invention, are pointed out with particularity in the claims annexed to and forming a part of this disclosure. For a better understanding of the invention, its operating advantages, and the specific objects obtained by its use, reference should be made to the accompanying drawings and descriptive matter in which like characters of reference designate like parts throughout the several views.

DETAILED DESCRIPTION OF THE PREFERRED EMBODIMENT

Figure 2:
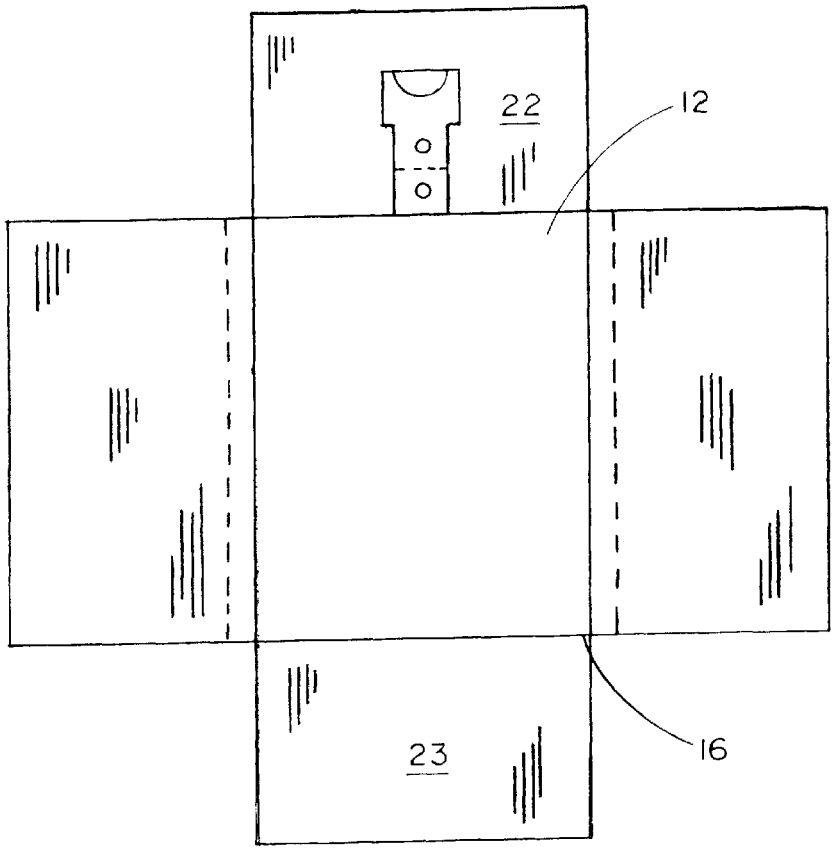
FIG. 2 is a front elevational and display side view of the package comprising the present invention in the package opened position.
Figure 1:
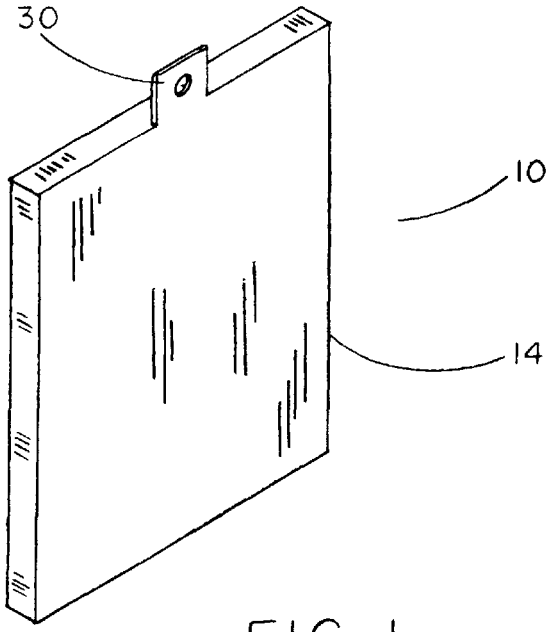
FIG. 1 is a perspective view of the package with self-contained hanging tab comprising the present invention.
Figure 3:
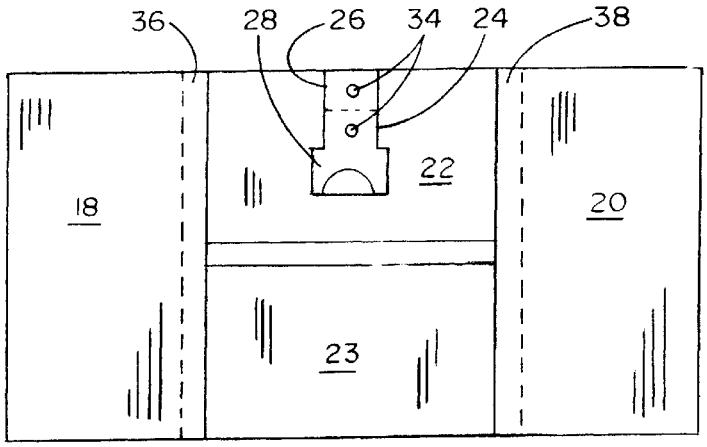
FIG. 3 is a rear elevational view of the package shown in FIGS. 1 and 2, the first and second side panels in the opened position showing the die cut self-contained tab and the secondary fold portions that provide a package thickness dimension.
Figure 6:
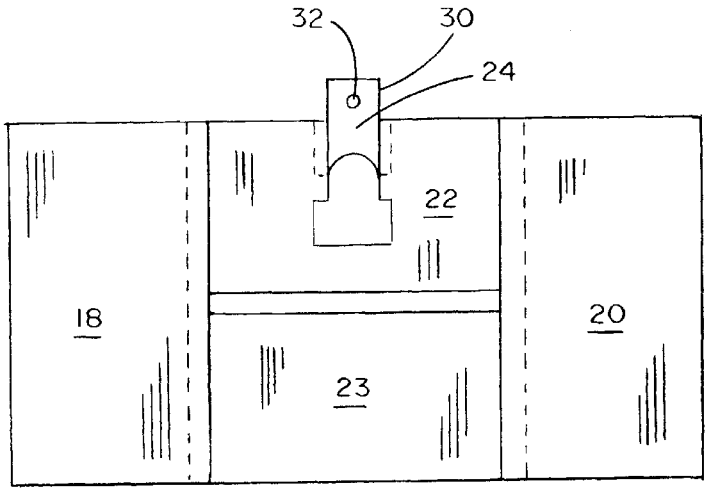
FIG. 6 is a rear elevational view of the package comprising the present invention with the self-contained hanging tab moved to its folded and hanging position.

Referring now to the drawings, and particularly to FIG. 1, a foldable package having a self-contained hanging tab is shown generally as FIG. 10 which is conveniently arranged to display market indicia 12 (FIG. 2) in an attractive manner. Package 10 includes a shell 14 having a front panel 16, first and second side panels 18, 20 foldably connected to front panel 16, and a top panel 22 foldably connected to front panel 16. Top panel 22 has a cutout tab shown generally as 24 having a lower front panel connecting portion 26 and an upper portion 28 all cut within top panel 22 and removable therefrom. Lower front connecting portion 26 is folded upon itself as shown best in FIG. 3 when moved away from top panel 22 to form an extending hanging tab 30 (FIGS. 1 and 6). An opening 32 is provided by the positioning of two apertures 34 (FIG. 3) to provide an extending hanging tab which can be used to hang the package on a supporting surface.

Figure 4:
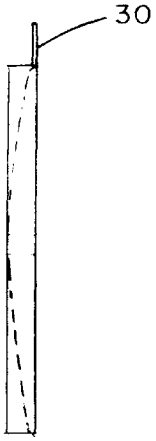
FIG. 4 is a side elevational view of the package comprising the present invention in the closed position.
Figure 5:
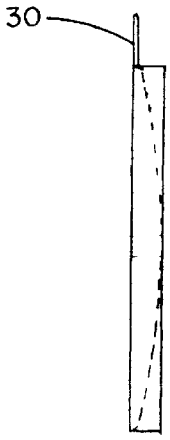
FIG. 5 is a side elevational view of the package comprising the present invention showing the side opposite side shown in FIG. 4.

First and second side panels 18, 20 each have a secondary fold portion 36, 38 positioned between them and front panel 16 to provide a package thickness dimension when first and second side panels 18, 20 are folded in the manner shown best in FIGS. 4 and 5. Thus, a three-dimensional effect is given the package through the use of a single shell 14, even though top panel 22 and bottom panel 23 simply fold directly downwardly and upwardly and do not have secondary fold portions thus providing a more economical package because of the ability to cut the shell as a single unit.

To form the extending hanging tab 30, the die cut cutout tab 24 is urged upwardly away from the top panel to fold upon itself as best shown in FIG. 6. The two layers of top portion 22 folded upon itself to form tab 30 gives sufficient strength to support the garment held within package 10.

While not limiting the application of the package of the present invention, a primary and significant use falls within the area of apparel items and, more particularly, in the area of ladies' fine denier fashion hosiery. When used with that product, the knitted hosiery product is positioned within the fold package in the manner described.

The above description presents the best mode contemplated of carrying out the present invention as depicted by the preferred embodiment disclosed. The combination of features illustrated by this embodiment provides its convenience of use and ease of manufacture. This invention is, however, susceptible to modifications and alternate constructions from the embodiment shown in the drawings and described above. Consequently, it is not the intention to limit it to the particular embodiment disclosed. To the contrary, the intention is to cover all modifications and alternative constructions found within the scope of the invention as generally expressed by the following claims.

What is claimed is:

1. A fold package comprising: a shell having a front panel, first and second side panels foldably connected to the front panel, a bottom panel foldably connected to the front panel, and a top panel foldably connected to the front panel, the top panel having a cutout tab with a lower front panel connecting portion and an upper portion all cut within the top panel and removable therefrom, the lower front connecting portion being folded upon itself when moved away from the top panel to form an extending hanging tab, and an opening extending through the folded upon itself lower front connecting portion to facilitate hanging the package.

2. A package comprising: a shell having at least one closing member foldably connected to the shell, one of the closing members having a tab forming a lower engaging portion and an upper wider portion all cut in and removed from said one of the closing members, the engaging portion being folded upon itself when moved away from said one of the closing members so that the engaging portion forms an extending hanging tab, and an opening extending through the folded upon itself lower engaging portion to facilitate hanging the package.

3. The package as claimed in claim 1, wherein the first and second side panels each have a secondary fold portion positioned between the front panel and the first and second side panels to provide a package thickness dimension.

4. The package as claimed in claim 2, wherein the shell has at least two closing members, two closing members each having a secondary fold portion positioned between the shell and said two closing members to provide a package thickness dimension.

5. A folded product package comprising: a shell having a front panel, first and second side panels foldably connected to the front panel, a bottom panel foldably connected to the front panel, and a top panel foldably connected to the front panel, the top panel having a cutout tab with a lower front panel connecting portion and an upper portion all cut within the top panel and removable therefrom, the lower front connecting portion being folded upon itself when moved away from the top panel to form an extending hanging tab, and an opening extending through the folded upon itself lower front connecting portion to facilitate hanging the package, and a knitted hosiery product positioned within the fold package.

6. A folded product package comprising: a shell having at least one closing member foldably connected to the shell, one of the closing members having a tab forming a lower engaging portion and an upper wider portion all cut in and removed from said one of the closing members, the lower engaging portion being folded upon itself when moved away from said one of the closing members so that the engaging portion forms an extending hanging tab, and an opening extending through the folded upon itself lower engaging portion to facilitate hanging the package, and a knitted hosiery product positioned within the package.

* * * * *

UNITED STATES PATENT AND TRADEMARK OFFICE

CERTIFICATE OF CORRECTION

PATENT NO : 6,145,659

DATED : November 14, 2000

INVENTOR(S) : Faircloth et al.

It is certified that error appears in the above-identified patent and that said Letters Patent is hereby corrected as shown below:

[56] References Cited

U.S. PATENT DOCUMENTS

| | | | |
|---|---|---|---|
| 877,347 | 1/1908 | Laz[e]ar | 206/806X |
| 3,695,508 | 10/1972 | Hoc[h]king | 206/806X |
| 4,020,[8]947 | 5/1977 | [Russell] Roccaforte | 206/[281]45.31 |
| 4,190,151 | 2/1980 | Russell | 206/281 |

Signed and Sealed this

First Day of May, 2001

*Attest:*

Nicholas P. Godici

NICHOLAS P. GODICI

*Attesting Officer*

*Acting Director of the United States Patent and Trademark Office*